US006679494B2

(12) United States Patent
Scovel

(10) Patent No.: US 6,679,494 B2
(45) Date of Patent: Jan. 20, 2004

(54) CHECKERBOARD COOKIE PACKAGE GAME

(76) Inventor: Joseph P. Scovel, 45 W. 10000 South, Suite 500, Sandy, UT (US) 84070

( * ) Notice: Subject to any disclaimer, the term of this patent is extended or adjusted under 35 U.S.C. 154(b) by 32 days.

(21) Appl. No.: 10/022,175

(22) Filed: Dec. 14, 2001

(65) Prior Publication Data

US 2002/0093138 A1 Jul. 18, 2002

Related U.S. Application Data

(60) Provisional application No. 60/256,065, filed on Dec. 15, 2000.

(51) Int. Cl.[7] ..... A63F 3/00

(52) U.S. Cl. ..... 273/261; 273/283; 273/284; 273/260; 273/287; 426/138

(58) Field of Search ..... 273/258, 260, 273/261, 262, 283, 284; 437/393, 127, 138, 139, 140; 426/138, 139, 140

(56) References Cited

U.S. PATENT DOCUMENTS

| | | | | | |
|---|---|---|---|---|---|
| 128,011 | A | | 6/1872 | Booth | |
| 1,632,673 | A | * | 6/1927 | Paulus | 273/142 R |
| 2,315,164 | A | | 3/1943 | Schiller | |
| 2,529,661 | A | | 11/1950 | Millstein | |
| 2,614,842 | A | * | 10/1952 | Rice | 273/258 |
| 3,191,184 | A | * | 6/1965 | Durstewitz | 273/249 |
| 3,430,962 | A | * | 3/1969 | Davenport | 273/239 |
| 3,459,356 | A | * | 8/1969 | Sparks | 229/120.07 |
| 3,506,353 | A | * | 4/1970 | Gilchrist | 355/102 |
| 3,531,123 | A | * | 9/1970 | Peebles | 273/260 |
| 3,565,321 | A | * | 2/1971 | Weiss | 220/23.8 |
| 3,770,278 | A | | 11/1973 | Mueller | |
| 3,917,273 | A | * | 11/1975 | Blakewood, III | 273/261 |
| 4,696,473 | A | | 9/1987 | Wyzykowski | |
| 4,733,863 | A | | 3/1988 | Novotny | |
| 4,961,583 | A | * | 10/1990 | Koch et al. | 273/260 |
| 4,988,110 | A | * | 1/1991 | Zuckerman | 273/286 |
| 5,162,126 | A | * | 11/1992 | Thorner et al. | 426/138 |
| 5,472,208 | A | * | 12/1995 | Berry | 273/260 |
| 5,542,678 | A | | 8/1996 | Woodbridge | |
| 5,690,333 | A | | 11/1997 | Danner et al. | |

OTHER PUBLICATIONS

US 2001/0031449 A1 Zwiers.*

* cited by examiner

*Primary Examiner*—Benjamin H. Layno
*Assistant Examiner*—V K Mendiratta
(74) *Attorney, Agent, or Firm*—Clayton, Howarth & Cannon, P.C.

(57) ABSTRACT

A checkerboard confectionary game that includes a box with a checkerboard pattern disposed on one surface to form a game board and a checkerboard pattern formed on a side surface such that multiple boxes can be positioned to form stacks of boxes with a checkerboard appearance, playing pieces that may be individually wrapped cookies of two designs with unique moves, and unique capture and winning rules for the game.

28 Claims, 5 Drawing Sheets

CHECKERBOARD COOKIE PACKAGE GAME

CROSS-REFERENCE TO RELATED APPLICATIONS

This application claims the benefit of U.S. Provisional Application No. 60/256,065, filed Dec. 15, 2000, which is hereby incorporated by reference herein in its entirety, including but not limited to those portions that specifically appear hereinafter.

STATEMENT REGARDING FEDERALLY SPONSORED RESEARCH OR DEVELOPMENT

Not Applicable.

BACKGROUND OF THE INVENTION

1. The Field of the Invention

The present invention relates generally to games that include edible pieces, and more particularly, but not necessarily entirely, to a game using a checkerboard box and confectionary pieces.

2. Description of Related Art

It has been well known in the prior art to include a game as a promotional item with foodstuffs, such as cereal, drinks, candy or cookies. One example of such promotional game is found in U.S. Pat. No. 5,542,678 (issued Aug. 6, 1996 to Woodbridge). Such promotional games have been incorporated into the packaging of candy confections, as in U.S. Pat. No. 4,733,863 (issued Mar. 29, 1988 to Novotny) and U.S. Pat. No. 4,988,110 (issued Jan. 29, 1991 to Zuckerman et al.), each of which is incorporated by reference, herein in its entirety. However, most of these games have playing boards that are separate pieces, or require the package to be completely disassembled to be used. Additionally, these games all feature separate pieces included with the foodstuff, or use candy confections as the game pieces.

It is noteworthy that none of the prior art known to applicant provides a game where the playing board is not either separate from the packaging or requires disassembly of the packaging to use, and the playing pieces consist of foodstuff other than candy. Further, the candy pieces used in these known games are merely taken directly from the packaging and then are directly touched as they are handled by those playing the game. This allows the candy to come into contact with whatever may be in the environment where the game is played, and to be extensively handled in multiple games before it is consumed.

The prior art is thus characterized by several disadvantages that are addressed by the present invention. The present invention minimizes, and in some aspects eliminates, the above-mentioned failures, and other problems, by utilizing the methods and structural features described herein.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1:
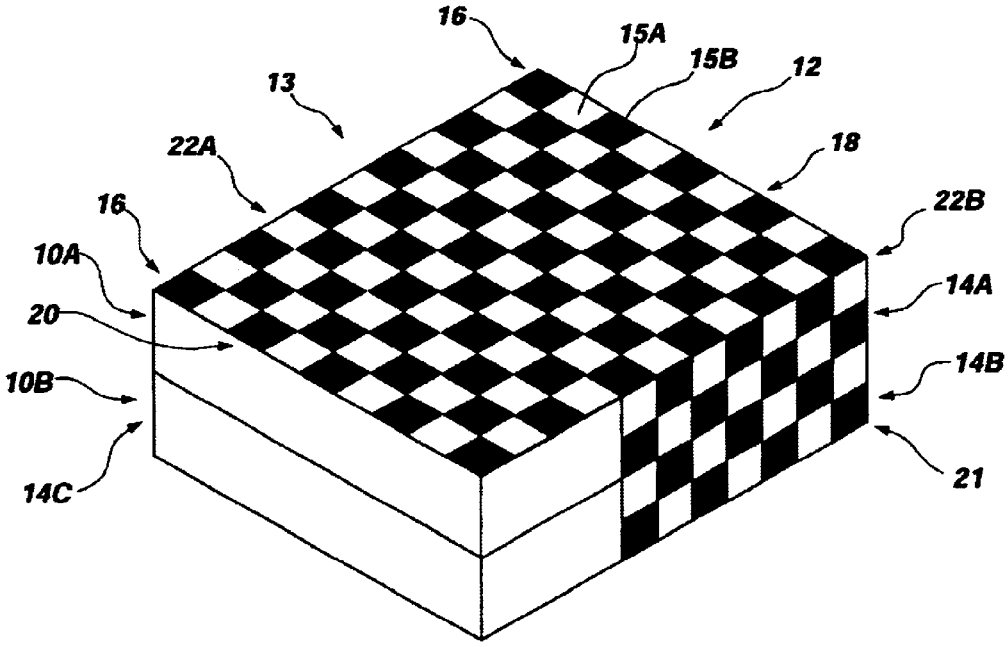
FIG. 1 is a perspective view of two cookie boxes made in accordance with one possible embodiment utilizing the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps.

It is an advantage of the present invention to provide a game including edible pieces that are a candy confection.

It is another advantage of the present invention to provide a game including edible pieces with a game board that is integrated into the package but does not require the package be disassembled to use the game board.

It is a further advantage of the present invention, in accordance with one aspect thereof, to provide a game including edible pieces where the pieces are not directly touched by one playing the game, when the pieces are handled to play the game.

It is also an advantage of the present invention to provide a game featuring edible pieces that includes a unique package such that a number of the packages may be combined to create an aesthetically pleasing promotional display.

It is an additional advantage of the invention, in accordance with one aspect thereof, to provide a unique form of playing checkers that incorporates an additional level of strategy.

The above advantages and others not specifically recited are realized in a specific illustrative embodiment of a checkerboard cookie game that includes a box with a checkerboard pattern disposed on one surface to form a game board and a checkerboard pattern formed on a side surface such that multiple boxes can be positioned to form stacks of boxes with a checkerboard appearance, playing pieces that are individually wrapped cookies of two designs with unique moves, and unique capture and winning rules for the game.

Additional advantages of the invention will be set forth in the description which follows, and in part will be apparent from the description, or may be learned by the practice of the invention without undue experimentation. The advantages of the invention may be realized and obtained by means of the instruments and combinations particularly pointed out in the appended claims.

Referring now to FIG. 1, two boxes 10A and 10B made in accordance with the principles of the present invention are depicted. Box 10A is representative of one preferred embodiment of the package of the present invention. It will be appreciated that the package of the present invention may also be in the form of a bag rather than the box 10 within the scope of the present invention. Box 10A is used as packaging for a preferred embodiment of a checkerboard cookie game. Box 10A features a first surface 12, on which a game board pattern 13 is located. Preferably, the game board pattern is a checkerboard pattern. It is preferred that the first surface be either the lower surface, or the upper surface of the box 10. The pattern 13 is preferably printed upon the surface 12, but it may be integral to the surface 12. In embodiments where the pattern 13 is a checkerboard pattern, it is preferable to have the pattern 13 comprise the colors black and red. It is further preferred to have lines dividing the squares of the checkerboard pattern 13. It is preferable for the lines to be yellow. However, it will be appreciated by those skilled in the art that other colors and patterns may be used within the scope of the present invention. For example, the pattern 13 may be made of red and white colors.

Figure 7:
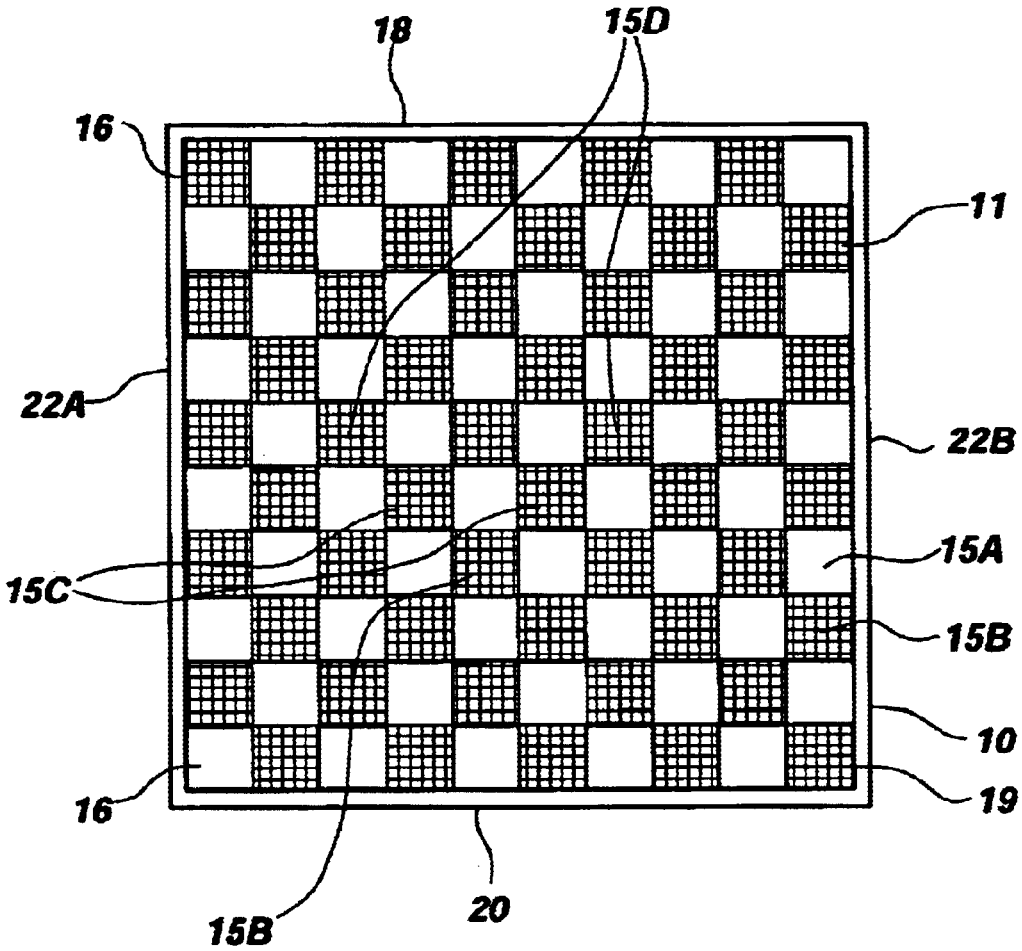
FIG. 7 is a top view of a possible embodiment of a bottom portion of a box made in accordance with the principles of the present invention.
Figure 8:
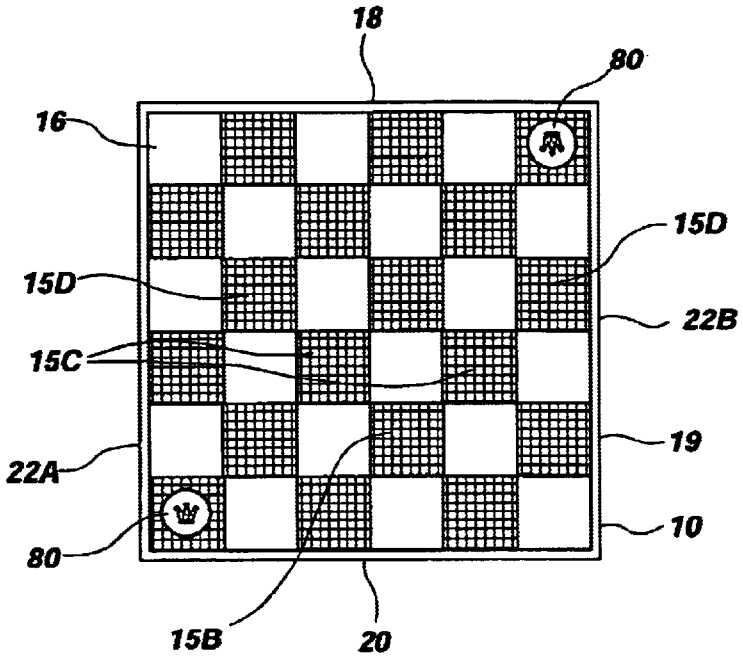
FIG. 8 is a top view of an additional possible embodiment of a bottom portion of a box made in accordance with the principles of the present invention.

The first surface 12, with the checkerboard pattern 13 may thus be used as the game board 11 for a checkerboard cookie game, in accordance with the principles of the present invention. It is preferred for the pattern 13 to comprise a square grid with an even number of squares 15 per side. It is more preferred for the pattern 13 to comprise a grid with eight squares 15 per side as shown most clearly in FIG. 6. It is also preferred for the pattern 13 to comprise a grid with ten squares 15 per side as shown most clearly in FIG. 7, or six squares 15 per side as shown in FIG. 8.

Figure 6:
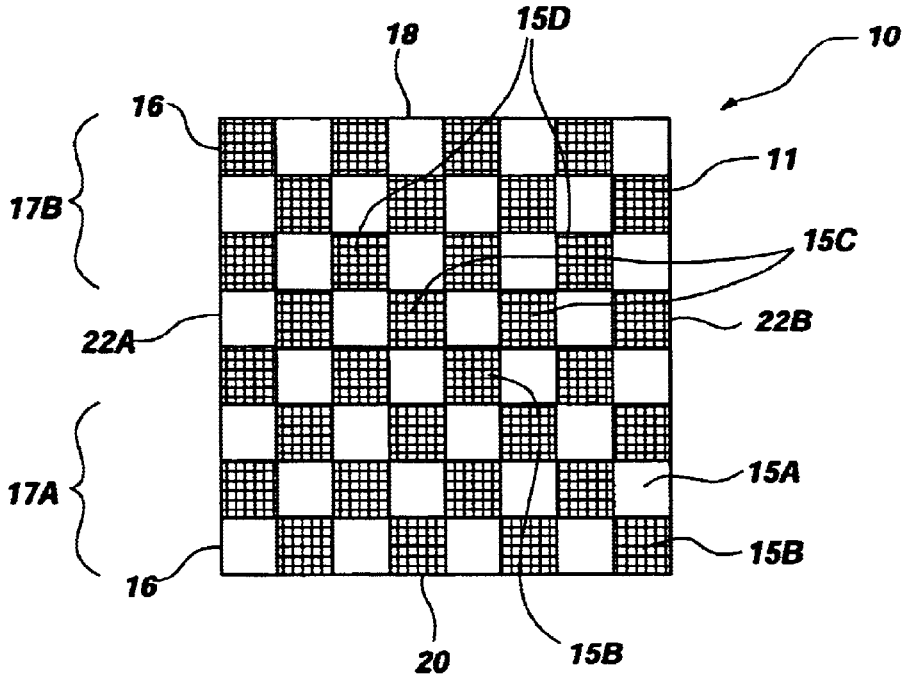
FIG. 6 is a bottom view of a possible embodiment of a box made in accordance with the principles of the present invention.
Figure 6A:
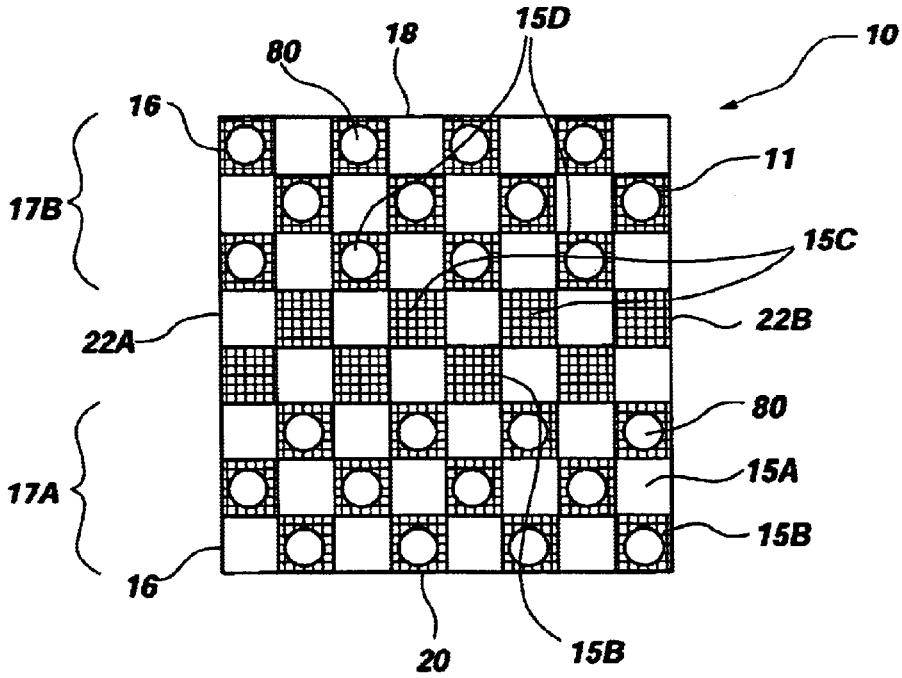
FIG. 6A is a bottom view of a possible embodiment of a box made in accordance with the principles of the present invention showing symbols where playing pieces are placed to start the game.
Figure 8A:
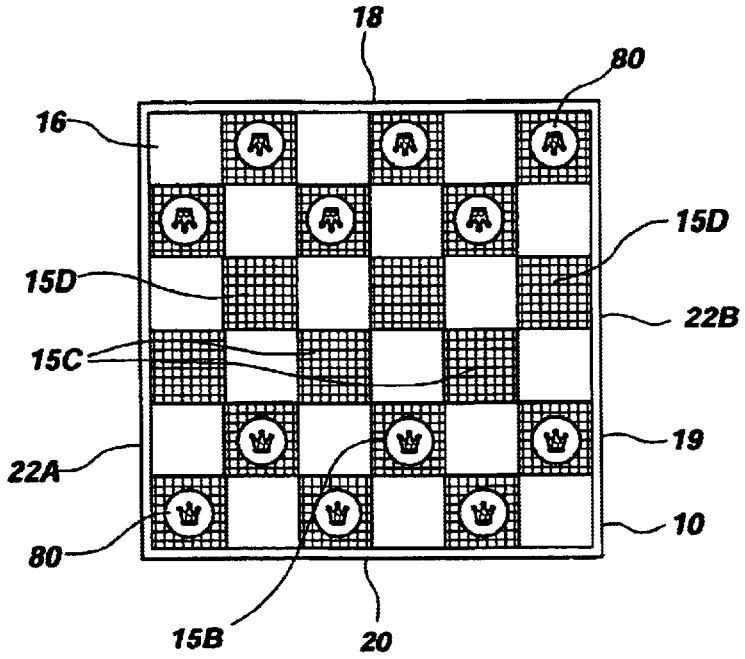
FIG. 8A is a top view of an additional possible embodiment of a bottom portion of a box made in accordance with the principles of the present invention, showing symbols where playing pieces are placed to start the game.

The game board 11 thus formed by the preferred checkerboard pattern 13 is a square grid having a first player end 18, a second player end 20 and two sides 22A and 22B. Board 11 consists of side-to-side rows of playing squares that alternate in color in the checkerboard pattern. In one embodiment, a symbol 80 as shown in FIGS. 6 and 8, such as a cookie representation for example, may be placed on one or more squares corresponding to the starting positions on the game board 11. As shown in FIGS. 6A and 8A, the symbol 80 may be placed on each square 15 corresponding to the starting positions on the game board 11. This configuration of the game board 11 may be helpful in setting up the game board 11 for playing. It will be appreciated that various different symbols may be used within the scope of the present invention for marking the starting positions on the game board 11.

It will also be appreciated that other embodiments of the checkerboard pattern 13 are possible and all such aspects are within the scope of the present invention. These other embodiments include for example, the printing of a checkerboard pattern 13 on the interior portion of the first surface 12, as shown most clearly in FIGS. 7 and 8, requiring the box 10 to be opened to use the checkerboard pattern 13 as a game board 11. In this embodiment, the box rim 19 may prevent the game pieces 30 from spilling off the playing board 11, and thereby assisting in playing while traveling in a vehicle for example.

Another possibility is the inclusion of a separate checkerboard pattern game board 11 inside the box 10, that could be removed and used to play the game. In embodiments including separate game boards 11, the game board 11 is preferably edible and more preferably, constructed from a confectionary material. For example, the game board 11 may be constructed from fruit leather, sometimes also referred to as fruit roll-ups. Fruit leather may be made from fruit which has been pureed and poured on a flat surface for drying. The game board 11 may be made from fruit leather of a uniform color, wherein a checkerboard pattern is formed by heating the alternating squares to alter the color of the fruit leather in a checkerboard configuration. It will be appreciated that the game board 11 may be made of other materials and the checkerboard pattern may be formed in other manners within the scope of the present invention.

Still referring to FIG. 1, the present invention optionally also includes structures that allow for multiple boxes to create a aesthetically pleasing unique appearance. When boxes 10A and 10B are stacked, as shown in FIG. 1, two of the side surfaces 14A and 14B of the boxes may be aligned to form a pattern 21 over both boxes 10A and 10B. In the preferred embodiments this pattern 21 consists of regularly repeating shapes, and in the more preferred embodiments a checkerboard pattern that appears identical to the checkerboard pattern 13. It is preferred to place a corresponding pattern 21 on the opposite side surface 14C of the box 10, such that adjacent stacks of boxes 10 may be positioned to enlarge the pattern. The patterned side surfaces 14 allow for a number of boxes 10 to be used to create an aesthetically pleasing display, which is advantageous for displaying the games for sale. It will be appreciated that many aesthetically pleasing patterns 21 can be placed on side surface 14 of the box 10 to form a larger pattern 21 as the pattern 21 carries across the plurality of boxes. All such patterns 21 are within the scope of the present invention.

Figure 2:
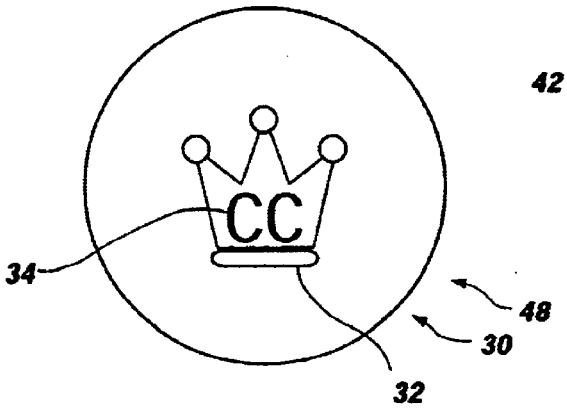
FIG. 2 is a top view of one possible embodiment of a cookie made in accordance with the principles of the present invention.
Figure 3:
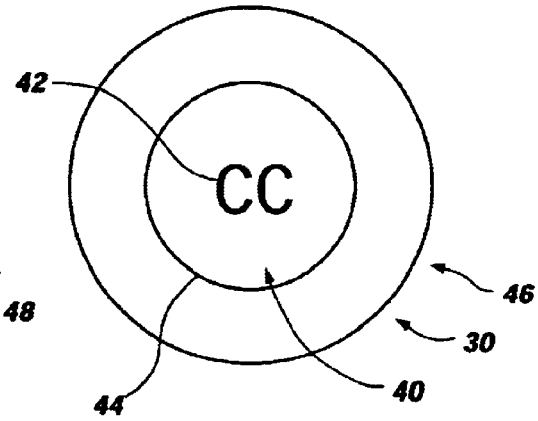
FIG. 3 is a top view of another possible embodiment of a cookie made in accordance with the principles of the present invention.

Referring now to FIGS. 2 and 3, two possible versions of edible game pieces 30 are shown. Edible game piece 30 is preferably a baked good and more preferably a cookie, although it is within the scope of the present invention to fashion the game piece from any edible substance, including candy and other confections.

It is preferred that the edible game pieces 30 be provided in at least two different colors forming two sets that may be differentiated by the players. It is more preferred to use two contrasting colors. This may be accomplished through the providing of differently colored and flavored pieces. The preferred flavors are chocolate and vanilla.

In the preferred embodiments shown in FIGS. 2 and 3, indicia are located upon the top surface of the edible game piece 30. These indicia serve as markers designating the edible game piece 30 use as a piece in a game. In FIG. 2, this indicia is located at the crown 32 and the lettering 34. In FIG. 3, this indicia is shown as the lettering 40, which is placed on a section of the upper surface that has a thinner cross section than at the edge of the edible game piece 30, represented as the area 40, bounded by the ridge 44. It will be appreciated that these indicia are representative only and that any indicia that may be placed upon the surface of a cookie, or other edible game piece 30, to differentiate the pieces is within the scope of the present invention.

In certain preferred embodiments, the two sets of game pieces 30 each include two types of pieces 30, movement pieces 46 and strategy pieces 48. These pieces may be differentiated using surface indicia, and are used for different purposes in the games that may be played with the pieces. It is preferred that the strategy pieces be marked with a crown 32 indicia.

The indicia may be formed on the edible game piece 30, by any suitable method. Examples of such methods include, use of an edible ink, use of a colored icing or frosting, and the baking of the cookie in a shaped pan to impart the shape of the pan to the cookie, as well as any other suitable method. It will be appreciated that all such methods and structures are within the scope of the present invention.

Figure 4:
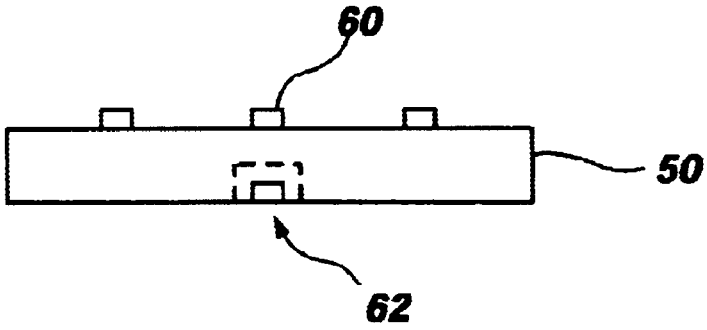
FIG. 4 is side view of an additional possible embodiment of a cookie made in accordance with the principles of the present invention.

Turning now to FIG. 4, another possible embodiment of an edible game piece 50 is shown. This embodiment features ridges 60 on the upper surface and corresponding grooves 62 shown in breakaway on the lower surface. In the preferred embodiments the edible game piece 50 is a cookie. By the interaction of the grooves 62 and the ridges 60, a number of pieces 50 may be stacked to form stable multi-cookie game-pieces, as may be required under the rules of different games. The interaction of the grooves 62 and the ridges 60 allow the pieces 50 to interact with one another to form a more stable stacked game piece. It will be appreciated that any structures that may be used to allow the pieces to be removably stacked may be used to accomplish this feature, including other ridge and groove formations, and that all such structures are within the scope of the present invention. It will be further appreciated that the grooves 62, ridges 60 or other interacting structures may be formed on the piece by any suitable means. It is preferred to form the interacting structures on cookie embodiments of piece 50 by baking the cookies in shaped pans, causing the structures to be present on the finished cookie. In embodiments with the interacting structures, it is preferred that strategy pieces 48 be configured to stack on top of the movement pieces 46.

In preferred embodiments of the game, the pieces 30, are individually packaged to allow the game to be played without the unwrapping and handling of edible game pieces by the players. It is preferred that pieces 30 are packaged in clear cellophane. This allows the pieces 30 to be viewed and used to play the game without the handling and exposure to the outside environment, before consumption. It will be appreciated that different colored wrapping, or wrapping with markings may also be used to distinguish between different varieties of pieces 30 within the scope of the present invention. It will also be appreciated that the pieces 30 may not be individually packaged within the scope of the present invention, but rather may be unwrapped within the box 10.

The present invention also includes a game. Preferably this game is played with the board and game pieces as herein described, although it could be practiced with other boards and pieces and all such practices fall within the scope of the present invention. A brief description of the way in which the game is played follows. The brief description outlines some of the different ways in which predetermined rules may control the play of the game between the opposing players. The rules may be printed on the box 10 or may be included within the box, or provided in any other manner known to those skilled in the art.

Each player takes the same number of colored playing pieces 30 from a two colored set. The sets include a number of movement pieces 46 and a number of strategy pieces 48. In the preferred embodiments, these pieces 30 are the cookies as described herein. The strategy pieces 48 preferably have a crown 32 on the upper surface, the movement pieces 46 have no crown. In one preferred embodiment, each player has six (6) strategy pieces 48, and twelve (12) movement pieces 46.

The movement pieces 46 are placed on the darker colored squares 15B (of FIG. 1) of the game board 11, in the traditional fashion with each players' pieces 30 on alternating squares in the side-to-side rows nearest each that player's end 18 or 20 of the game board 11. Preferably, each player also takes possession of the opponent's strategy pieces 48. In some alternative embodiments, the players may place the strategy pieces 48 on preselected squares.

The game then proceeds as a game of traditional checkers, as described most clearly in conjunction with FIGS. 2, 3 and 6. Two opposing players (not shown) take their respective places on opposite sides of the board 11 and place twelve movement pieces 46 each on the darker squares in their respective set-up zones 17A and 17B. The players move their movement pieces 46 from one darker colored square 15B to a diagonally adjacent square, in a forward and diagonal direction across the board 11, each player making one move in turn at a time. Opposing pieces are captured by moving one's piece 46 to cause it to jump from an adjacent dark square 15B over an opposing piece that resides for example on either of squares 15C, such that the jumping piece lands onto an opposite adjacent unoccupied square 15D. A regular movement piece 46 may accomplish such jumping in the forward diagonal direction only, while a strategy piece 48 may accomplish such jumping in either the forward diagonal direction or a rearward diagonal direction. Of course, the lighter colored squares may be used instead of the darker colored squares, if desired.

When a movement piece 46 reaches the side-to-side row 16 (of FIG. 1) nearest the opponent, it may be traded for a strategy piece 48 held by the opponent. In accordance with one method of playing a game, the strategy pieces 48 may move toward the opposite side of the board 11, back toward the player, or laterally within a row across a lighter colored empty space 15A (of FIG. 1). Movement pieces 46 may only be moved forwardly toward the opposing players side of the board 11.

In some preferred embodiments, a strategy piece 48 may only be captured by another strategy piece 48. In certain embodiments the strategy pieces 48 may only capture one opposing piece 30 in a turn.

Figure 5:
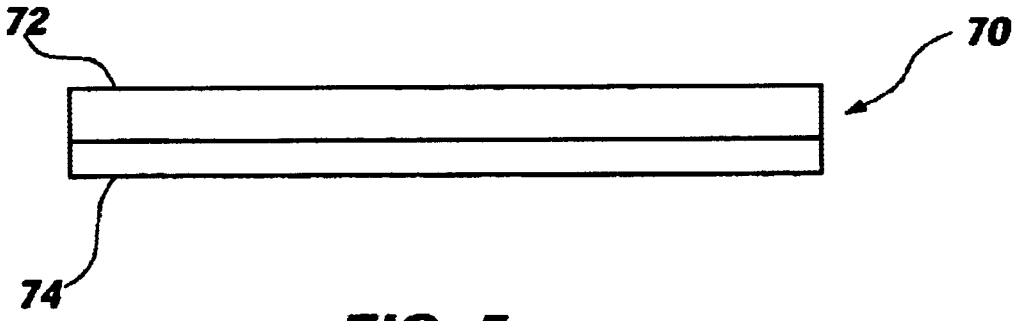
FIG. 5 is a side view of one possible embodiment of a selection piece made in accordance with the principles of the present invention.

In one preferred embodiment, the players determine who will take the first turn using a selection piece 70. One embodiment of a selection piece 70, made in accordance with the principles of the present invention, is depicted in FIG. 5. The selection piece 70 is a playing piece 30 having two flat surfaces 72 and 74, each flat surface indicating one set of playing pieces 30. Preferably each surface 72 or 74 is colored the same as one set of playing pieces 30. More preferably, the selection piece 70 is a cookie having a chocolate side 72 and a vanilla side 74.

The selection piece 70 is tossed or flipped onto the game board 11, as in a coin toss. The surface 72 or 74 of the selection piece 70 that faces upright determines that the player with the corresponding set of playing pieces will initiate the game by taking the first turn. In some preferred embodiments, the player who is selected will then consume the selection piece 70. It is preferred that the selection piece 70 also be individually packaged as described above.

In some preferred embodiments, the return of a strategy piece 48 to the side-to-side row 16 nearest the player controlling that strategy piece 48 allows that player to obtain an additional strategy piece 48 from the opponent. In certain embodiments, when a player has obtained all the strategy pieces 48 held by the opponent, the making of a move that would result in the obtaining of a strategy piece 48 from the opposing player instead allows the player to consume the opponent's strategy pieces 48 held by that player.

Play continues, in turn, until all of one player's pieces 30 on the game board 11 are captured, or until neither player is able to move (a stalemate). In the event of a stalemate, the players will each give all their remaining pieces 30 to the opponent. In the event of a complete capture of all pieces 30 on the game board by one player, the players may then each retain their remaining pieces 30 and the captured opposing pieces 30. In some preferred embodiments, this distributes individually wrapped differently colored cookies between the two players. In some other embodiments, the players must consume the pieces that are captured. For example, in one embodiment, the player that captures a piece may consume the piece, whereas in another embodiment, when a player captures a piece, the other player consumes the piece. Accordingly, it will be appreciated that the present invention, in accordance with at least one aspect thereof, provides a unique form of playing checkers that incorporates an additional level of strategy.

One preferred embodiment of the present invention may involve a smaller version of the box 10 and game board 11, that may be a complimentary item to be given by organizations or individuals such as airlines or real estate agents for example. The game board 11 may have a reduced number of squares 15, such as six (6) squares 15 per side as shown in FIG. 8. In this embodiment, each player may receive six (6) movement pieces 46 and two (2) strategy pieces 48. The game pieces 30 may include candy having different colors for each side, and different colors for the strategy pieces 48, such that candy of four different colors may be used. Other features previously discussed may be incorporated into the complimentary version, such as forming the game board 11 on the interior portion of the first surface 12, as shown in FIG. 8, so that the rim 19 of the box keeps the game pieces 30 from spilling, and placing symbols 80 such as cookies or candies as shown in FIG. 8A, on the starting positions of the squares 15.

It is also within the scope of the preferred invention to provide a game using the embodiments of the cookie playing pieces 30, similar to those shown in FIG. 4 to provide a method of playing traditional checkers with cookie pieces, including the stacking of the pieces.

In accordance with the features and combinations described above, a preferred method of playing a board game between two opponents involving both strategy and the consumption of confectionary game pieces, includes the steps of:

(a) providing a game board having borders defined by a first player end, a second player end and two sides, the game board having aligned forward-backward and side-to-side rows of playing spaces, respectively;

(b) providing a plurality of playing pieces, the playing pieces being divided into a first set of playing pieces and a second set of playing pieces; the first set of playing pieces and the second set of playing pieces each including a number of movement pieces and a number of strategy pieces;

(c) placing the movement pieces of each first and second set in a predetermined starting configuration on the playing spaces of the game board with movement pieces of the first set being placed in side-to-side rows adjacent the first player end and movement pieces of the second set being placed in rows adjacent to the second player end;

(d) moving the movement pieces about the game board to unoccupied playing spaces in accordance with predetermined rules, the movement pieces being moveable to jump and thereby capture the playing pieces of an opponent, the first and second sets of playing pieces each include a number of distinguishable strategy pieces, the movement pieces of each of the first and second set being replaceable by the strategy pieces of the respective first or second set when the movement piece has moved forwardly across the game board to a side-to-side row immediately adjacent to the corresponding player end, the strategy piece then moving about the game board in accordance with predetermined rules; and (e) consuming the opponent's playing piece when the opponent's playing piece has been captured.

It is further preferred for the method to include the additional steps described above in the description of the game.

It will be appreciated that certain embodiments of the present invention thus provide a game including edible pieces that are cookies rather than a candy confection, and a game board that is integrated into the package but does not require that the package be disassembled to use the game board.

It will be further appreciated that the present invention, in accordance with one aspect thereof, provides a game including edible pieces where the pieces are not directly touched by one playing the game, when the pieces are handled to play the game.

It will also be appreciated that certain embodiments of the present invention provide a game featuring edible pieces that includes a unique package such that a number of the packages may be combined to create an aesthetically pleasing promotional display.

In accordance with the above, and for further clarification on one possible set of game rules, the games rules below are provided as an option:

(1) Open your box of cookies and each player receives 12 cookies (playing pieces or movement pieces 46) and six special "Kings" (also referred to herein as "strategy pieces" 48). The rest of the cookies are for another game. There is one "cookie toss" cookie (item 70).

(2) Each player assembles his or her cookies according to the color they represent (chocolate or vanilla)

(3) Each player holds the "Kings" 48 of their opponents in "captivity." You cannot eat them, yet. The Kings 48 are surrendered only when your opponent successfully lands on "Kings Row" 16.

(4) The game is begun by a flip of the cookie 70. Each side chooses a flavor, either chocolate or vanilla. The winner of "cookie toss" immediately gets to eat the "cookie toss" cookie 70 in order to start the game.

(5) As a player jumps and captures the opponent's cookie the captured cookie is removed from the game forever and eaten at once. Alternatively, it can be saved for a future game. Captured cookies can never re-enter the same game.

(6) Turn the cookie box 10A upside down. This is your playing board. Begin the game as if you were playing regular checkers.

(7) When a player reaches "Kings Row" 16, he or she immediately trades the movement piece cookie 46 for one of his Kings 48 being held in "captivity" by his or her opponent. The traded in cookie 46 goes to the opponent and must be eaten by him or her at once.

(8) When a player has earned a King 48, he can move anywhere on the board 10A he wants, either forward or backward or from side to side. However, the King 48 can only jump one opponent piece at a time!

(9) A regular movement piece 46 can never jump a King 48 even if the King 48 is in the normal movement path. Only a King 48 can jump, capture and eat another King! When a player reaches the opponent's King Row 16 with his or her King the opponent must surrender another King to said player. If a player has retaken all of his or her Kings and still lands on Kings Row 16 he or she may take one of the Kings 48 he has in captivity and eat it.

(10) The game is over when one player has captured and eaten all of the opponent's cookies. In the event of a stalemate, both sides must surrender the rest of their cookies to the other side.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of playing a board game between two opponents involving both strategy and the consumption of confectionary game pieces, comprising the steps of:

(a) providing a game board having borders defined by a first player end, a second player end and two sides, the game board having aligned forward-backward and side-to-side rows of playing spaces, respectively;

(b) providing a plurality of playing pieces, the playing pieces being divided into a first set of playing pieces and a second set of playing pieces; the first set of playing pieces and the second set of playing pieces each including a number of movement pieces and a number of strategy pieces;

(c) placing the movement pieces of each first and second set in a predetermined starting configuration on the playing spaces of the game board with movement pieces of the first set being placed in side-to-side rows adjacent the first player end and movement pieces of the second set being placed in rows adjacent to the second player end;

(d) moving the movement pieces about the game board to unoccupied playing spaces in accordance with predetermined rules, the movement pieces being moveable to jump and thereby capture the playing pieces of an opponent, the first and second sets of playing pieces each including a number of distinguishable strategy pieces, the movement pieces of each of the first and second set being replaceable by the strategy pieces of the respective first or second set when the movement piece has moved forwardly across the game board to a side-to-side row immediately adjacent to the corresponding player end, the strategy piece then moving about the game board in accordance with the predetermined rules; and (e) consuming the opponent's playing piece when the opponent's playing piece has been captured;

wherein the strategy pieces are not placed on the game board at the commencement of the game.

2. The method of claim 1, further comprising providing twelve movement pieces in each set.

3. The method of claim 1, further comprising providing six strategy pieces in each set.

4. The method of claim 1, wherein the predetermined starting configuration on the playing spaces of the game board of the movement pieces of the first set and second set are on alternating playing squares of the side-to-side rows adjacent the first player end and second player end of the game board.

5. The method of claim 1, wherein the predetermined rules further provide that movement pieces may be moved forward across the game board on diagonally adjacent playing squares.

6. The method of claim 1, wherein the predetermined rules further provide that movement pieces may jump over an opponent's movement pieces onto an unoccupied diagonally adjacent playing square, to thereby capture the opponent's movement piece.

7. The method of claim 1, wherein the predetermined rules further provide that strategy pieces may be moved forward or backward onto diagonally adjacent squares.

8. The method of claim 1, wherein the predetermined rules further provide that strategy pieces may be moved to an unoccupied square in the same side-to-side row, across one adjacent playing square.

9. The method of claim 1, wherein the predetermined rules further provide that strategy pieces may jump over an opponent's playing pieces onto an unoccupied diagonally adjacent playing square, to thereby capture the opponent's playing piece.

10. The method of claim 1, wherein the predetermined rules further provide that the games concludes when one opponent has captured and consumed all the opponent's playing pieces.

11. The method of claim 1, wherein the predetermined rules further provide that the game concludes when neither opponent may move their respective playing pieces.

12. The method of claim 1, wherein the predetermined rules further provide that in the event neither opponent may move their respective playing pieces, each opponent will surrender their playing pieces to the other.

13. The method of claim 1, wherein the predetermined rules provide that each opponent shall take alternating turns moving a playing piece in accordance with the rules.

14. The method of claim 13, wherein the predetermined rules further provide that said alternating turns end when one of said strategy pieces is used to capture one of said playing pieces.

15. The method of claim 13, further comprising the step of selecting which opponent takes an initial turn.

16. The method of claim 15, wherein the step of selecting is conducted using a selection piece.

17. The method of claim 16, wherein the selection piece is a flat playing piece having a first surface and a second surface.

18. The method of claim 17, wherein the first surface has a color that is the same as a color of the first set of playing pieces.

19. The method of claim 18, wherein the second surface has a second color that is the same as a color of the second set of playing pieces.

20. The method of claim 19, wherein the selection piece is tossed in the air, and the top surface on landing determines the order of the opponents turns.

21. The method of claim 20, further comprising the step of the allowing the opponent selected to take the initial turn to consume the selection piece.

22. The method of claim 21, wherein the selection piece is a cookie.

23. The method of claim 1, wherein each opponent's turn continues until one of said playing pieces is moved in accordance with the rules, and none of said playing pieces are captured.

24. The method of claim 1, further comprising the step of providing said game board on a package, wherein said package is configured to contain said plurality of playing pieces.

25. A method of playing a board game between two opponents involving both strategy and the consumption of confectionary game pieces, comprising the steps of:

(a) providing a game board having borders defined by a first player end, a second player end and two sides, the game board having aligned forward-backward and side-to-side rows of playing spaces, respectively;

(b) providing a plurality of playing pieces, the playing pieces being divided into a first set of playing pieces and a second set of playing pieces; the first set of playing pieces and the second set of playing pieces each including a number of movement pieces and a number of strategy pieces;

(c) placing the movement pieces of each first and second set in a predetermined starting configuration on the playing spaces of the game board with movement pieces of the first set being placed in side-to-side rows adjacent the first player end and movement pieces of the second set being placed in rows adjacent to the second player end;

(d) moving the movement pieces about the game board to unoccupied playing spaces in accordance with predetermined rules, the movement pieces being moveable to jump and thereby capture the playing pieces of an opponent, the first and second sets of playing pieces each including a number of distinguishable strategy pieces, the movement pieces of each of the first and second set being replaceable by the strategy pieces of the respective first or second set when the movement piece has moved forwardly across the game board to a side-to-side row immediately adjacent to the corresponding player end, the strategy piece then moving about the game board in accordance with the predetermined rules;

(e) consuming the opponent's playing piece when the opponent's playing piece has been captured; and (f) placing the strategy pieces of each set in the possession of the opponent, prior to the commencement of the game.

26. The method of claim 25, further comprising the step of consuming the opponent's strategy pieces that are not used to replace movement pieces during the game.

27. A confectionary board game for use in playing a game by at least one player, said confectionary board game comprising:

a plurality of playing pieces made of an edible material, said plurality of playing pieces being individually wrapped with a clear wrapping so that said plurality of playing pieces can be seen through said clear wrapping, said plurality of playing pieces comprising movement pieces and strategy pieces distinguishable from said movement pieces; and a package configured to contain said plurality of playing pieces, said package having a top cover, a bottom cover and a side;

wherein said bottom cover of said package includes a playing board integrally formed thereon for defining a playing area to be used with said plurality of playing pieces to play said game;

wherein said side of said package comprises a checkerboard pattern being configured such that when a plurality of said packages are arranged in a stack, said checkerboard patterns on each of said packages combine to form a larger checkerboard display;

wherein said strategy pieces are used to replace said movement pieces so that stacking said pieces on top of each other is not necessary to distinguish the playing pieces;

wherein the playing pieces are cookies;

wherein the playing pieces include a first set of playing pieces and a second set of playing pieces;

wherein the first set of playing pieces comprise a first color;

wherein the second set of playing pieces comprise a second color that is distinguishable from the first color by human eyes;

wherein the strategy pieces are differentiated from the movement pieces by a first indicia;

wherein the first indicia comprises a crown symbol on the strategy pieces;

wherein the playing board comprises a checkerboard having a number of side-to-side rows;

wherein the board game further comprises a selection piece, said selection piece comprising a cookie having a first surface and a second surface, said first surface having the same color as the first set of playing pieces, and the second surface having the same color as the second set of playing pieces, wherein the selection piece is tossed in the air, and the top surface on landing determines the set of playing pieces used to take a first turn.

28. The confectionary board game of claim 27, wherein each side-to-side row includes an even number of playing squares, and wherein the playing board has eight playing squares in each side-to-side row.

* * * * *